US006684408B2

(12) United States Patent
Rindle et al.

(10) Patent No.: US 6,684,408 B2
(45) Date of Patent: Feb. 3, 2004

(54) JACKET-TYPE GARMENT

(75) Inventors: Markus Rindle, Boulder, CO (US); John Joseph Collier, Boulder, CO (US)

(73) Assignee: Salomon S.A., Metz-Tessy (FR)

( * ) Notice: Subject to any disclaimer, the term of this patent is extended or adjusted under 35 U.S.C. 154(b) by 0 days.

(21) Appl. No.: 10/095,047

(22) Filed: Mar. 12, 2002

(65) Prior Publication Data

US 2003/0172435 A1 Sep. 18, 2003

(51) Int. Cl.[7] ..... A41D 1/02
(52) U.S. Cl. ..... 2/108
(58) Field of Search ..... 2/69, 102, 108, 2/94, 247–253, DIG. 1

(56) References Cited

U.S. PATENT DOCUMENTS 3,761,962 A * 10/1973 Myers ..... 2/79
5,465,425 A * 11/1995 Crispin ..... 2/102
5,642,526 A * 7/1997 Thompson ..... 2/79
5,809,576 A * 9/1998 Huston et al. ..... 2/247
5,810,699 A * 9/1998 Nadeau ..... 182/105
6,314,580 B1 * 11/2001 Greenberg et al. ..... 2/108

* cited by examiner

*Primary Examiner*—Tejash Patel
(74) *Attorney, Agent, or Firm*—Greenblum & Berstein, P.L.C.

(57) ABSTRACT

A garment of the jacket type including an outer envelope covering the upper body of a user and provided with a closure system. The garment includes an inner carrying system constituted of an inner envelope distinct from the outer envelope and enveloping the user's upper body over at least a portion of the height of the upper body, wherein the inner envelope is fixed at its upper portion to the outer envelope, wherein the inner envelope is provided with a closure system separate from those of the outer envelope, and wherein the inner envelope includes a pocket arrangement for carrying objects. The inner envelope of the garment is fixed to the outer envelope in the area of the torso.

40 Claims, 4 Drawing Sheets

JACKET-TYPE GARMENT

BACKGROUND OF THE INVENTION

1. Field of the Invention

The present invention relates to a garment such as a jacket, windbreaker, or anorak, i.e., a garment adapted to cover the user's upper body or bust.

More specifically, it relates to the garments of this type adapted to outdoor sporting activities.

2. Description of Background and Relevant Information

Garments of the aforementioned type are generally provided on their inner wall with multiple pockets adapted to receive various objects, such as a wallet, glasses, a portable telephone, portable radio, cassette or CD player, etc.

These various objects can get in the way during the sporting activity due to the accelerations, twisting movements, etc., that are applied to the garment.

SUMMARY OF THE INVENTION

An object of the present invention is to remedy the aforementioned disadvantages, and to provide a jacket-type garment enabling an improved storage of the various objects.

This object is achieved in the garment according to the invention, which is of the jacket type and includes an outer envelope covering the bust, or upper half, of a user's body and is provided with closure elements or means, wherein it has an inner carrying system constituted of an inner envelope distinct from the outer envelope, and enveloping the upper part of the user's body, or over at least a portion of the height of the upper part of the user's body, wherein the inner envelope is fixed at its upper portion to the outer envelope, wherein it is provided with closure elements or means separate from those of the outer envelope, and wherein it includes a structure, of the pocket type, for carrying objects.

Thus, the objects are carried in direct contact with the body, independently of the outer envelope, and are thereby much less tossed around and shaken during the sporting activity.

As a result, there is an improved sensation of comfort for the user.

Moreover, as the objects remain affixed to the user's body, they are much less prone to inadvertent falls and losses during the opening of the outer envelope, for example when the user wishes to cool off a little bit, or when he or she wishes to reach one of those objects.

According to one preferred embodiment, the inner envelope is provided, at its lower end, with a skirt made of a waterproof material extending up to the hip area and provided with an elastic at its lower end. The purpose of such a skirt is to ensure a continuity of the waterproofness between the bottom of the jacket and the top of the pants, so as to avoid the penetration of outside elements, in particular snow, within these user's garments.

Such a construction is particularly advantageous for a sporting activity such as skiing or snowboarding, in particularly in volatile powdery snow.

BRIEF DESCRIPTION OF DRAWINGS

The invention will be better understood and other characteristics thereof will become apparent from the description that follows, with reference to the annexed schematic drawings illustrating a preferred embodiment, by way of a non-limiting example, and in which.

DETAILED DESCRIPTION OF THE INVENTION

The various drawing figures show the invention as applied to a sports jacket of the anorak type, i.e., designed primarily for winter sports.

The invention is not intended to be limited to this particular type of application, and can be extended to any type of garment for which similar or identical problems must be resolved.

Figure 1:
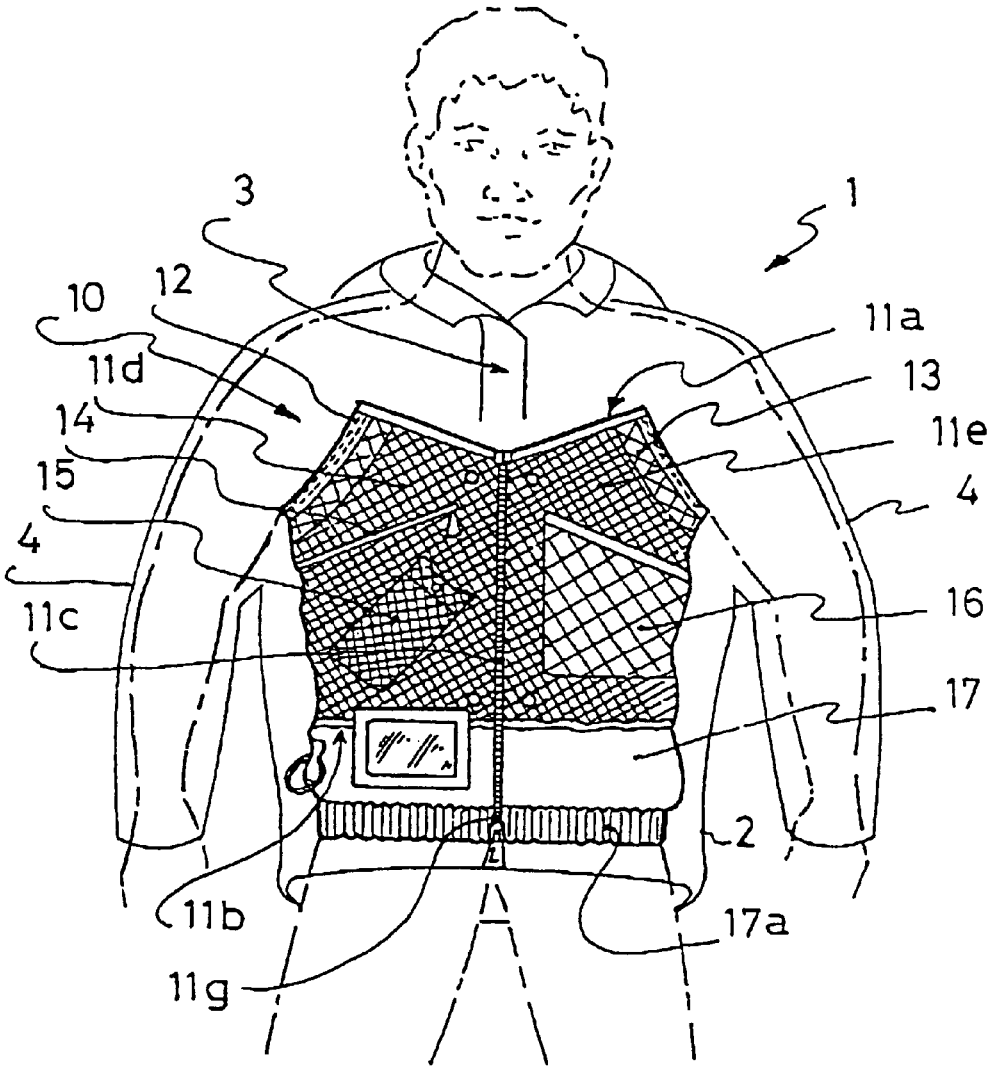
FIG. 1 is a front view of a sports jacket according to the present invention.
Figure 2:
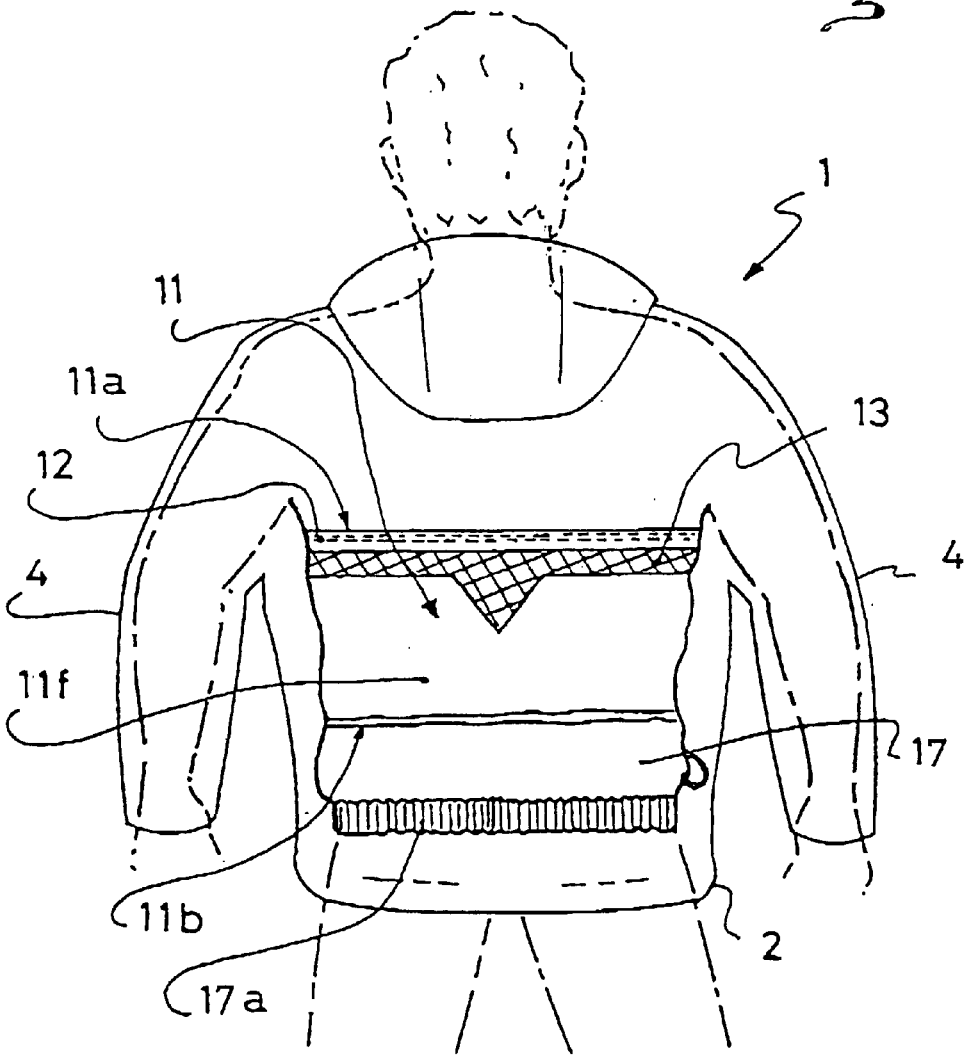
FIG. 2 is a rear view of the jacket of FIG. 1.
Figure 3:
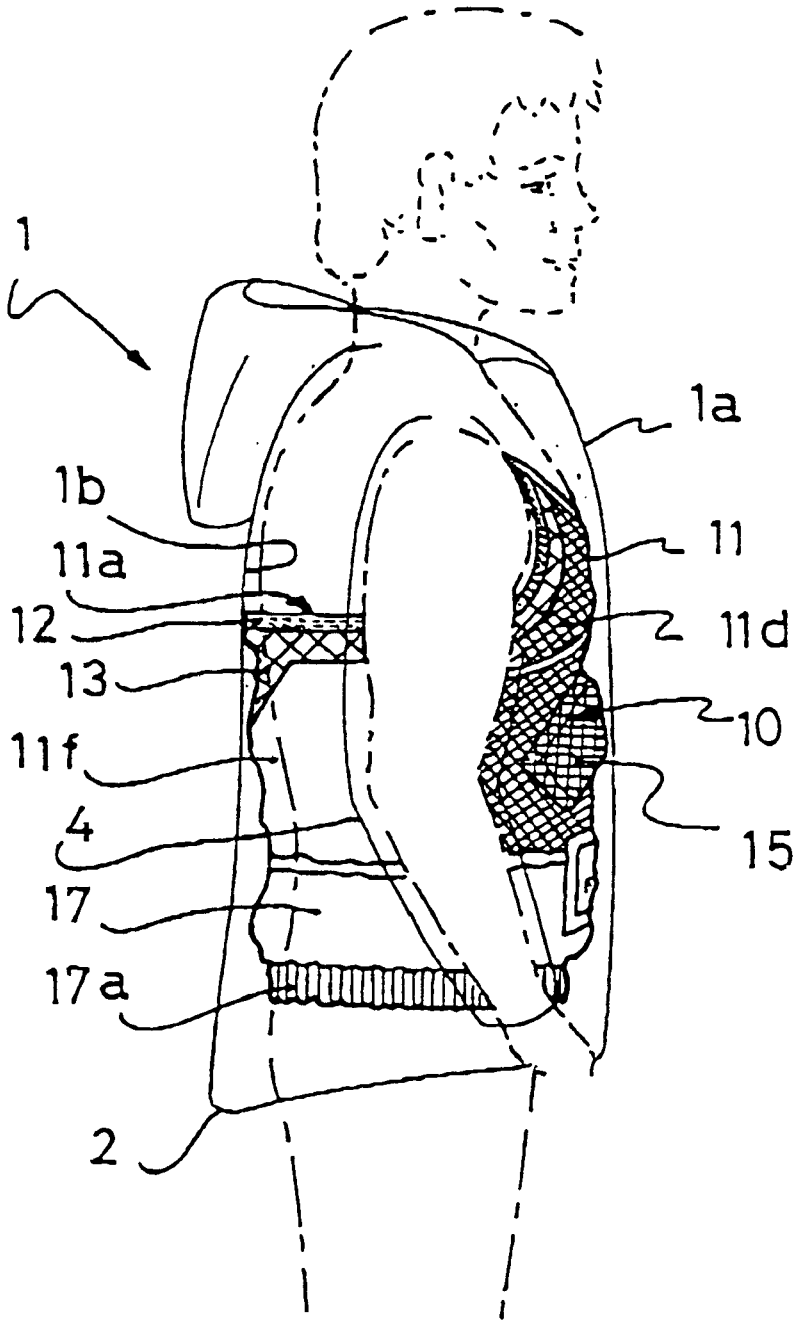
FIG. 3 is a side view of the jacket of FIG. 1.
Figure 4:
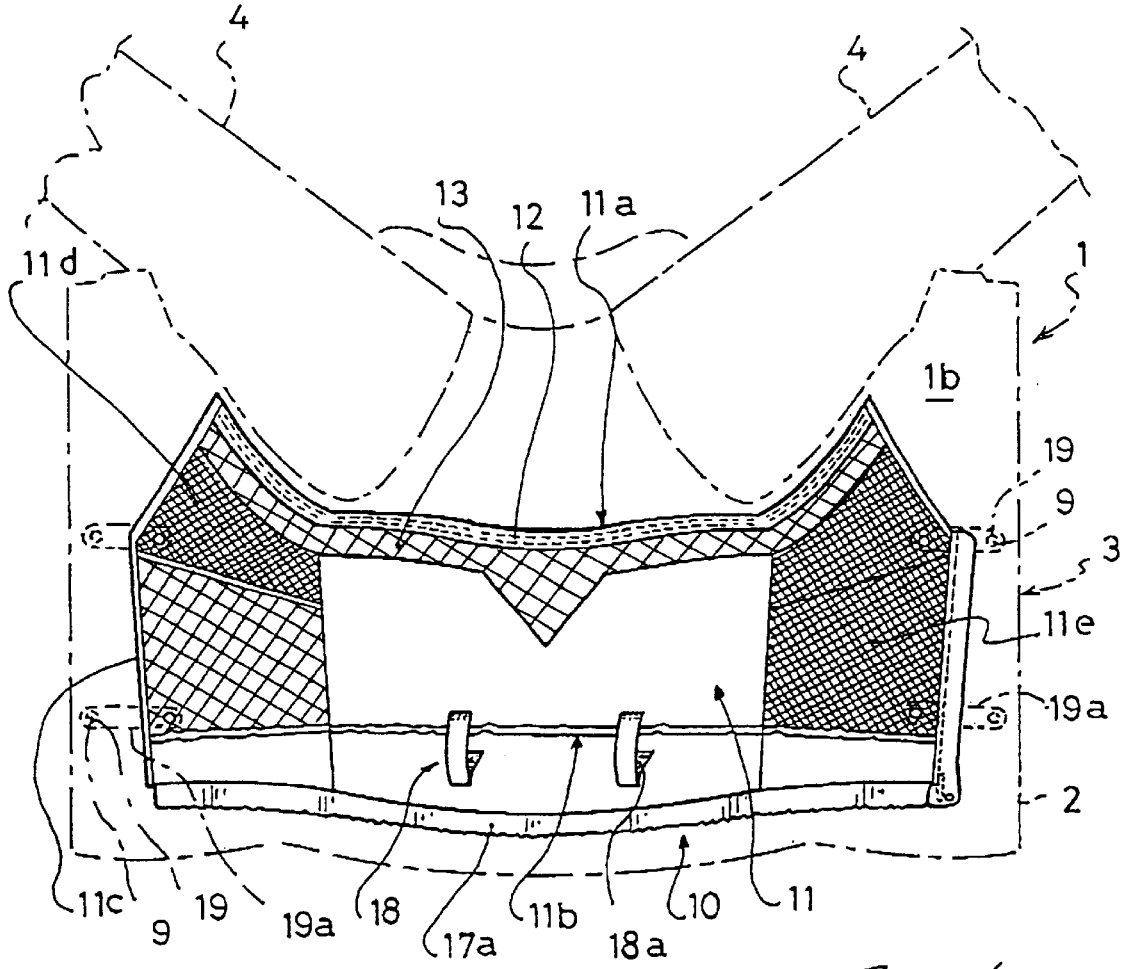
FIG. 4 is a flattened view of the jacket of FIG. 1.

As shown in FIG. 1, in particular, the jacket according to the invention is primarily comprised of a flexible outer envelope 1, shown in solid lines in FIGS. 1–3, and in broken lines in FIG. 4, and of a carrying system 10.

The outer envelope 1 comprises a substantially cylindrical portion 2 with sleeves 4, the cylindrical portion covering the user's upper body and opening at the front by a front opening 3.

The front opening 3 extends preferably straight vertical, but can also be curved. It can be closed by any closure means known in itself, such as a zipper, self-gripping system (i.e., hook and loop fasteners, such as VELCRO® brand hook and loop fasteners), snap fasteners, buttons, etc.

Depending on the type of sporting activity intended by the user, the jacket can be waterproof, thermally insulated, ventilated, etc. Similarly, the sleeves 4 can be long, short, or even nonexistent.

The envelope 1 is further constituted of an outer surface 1*a* and an inner surface 1*b*, the outer surface 1*a* constituting the outermost surface of the jacket.

The carrying system 10 includes a flexible envelope 11 separate from the outer envelope or jacket 1 and arranged within the latter.

Once closed, the inner envelope 11 has a substantially cylindrical shape and envelopes the user's upper body over at least a portion of the height the upper body, i.e., at least from the waist up to the chest. As can be seen in the embodiment of the sports jacket depicted in figures, the inner envelope 11 extends upwardly to an uppermost extent beneath the top of the shoulders of the user's body.

As the case may be, and as described below, the inner envelope 11 can extend further downward and/or upward, in particular down to the hips and/or up to the shoulders.

In the example shown in FIGS. 1–4, this inner envelope 11 extends from the chest down to the hips.

The inner envelope includes an upper end 11*a*, a lower end 11*b*, and a front opening 11*c*.

It is fixed at its upper end 11*a* to the inner surface 1*b* of the outer envelope 1, for example by a stitched seam 12.

Other fixing methods, such as gluing, welding, can be used.

It is also possible to provide a detachable fixing, for example, by using a self-gripping mechanism, buttons, snap fasteners, a zipper, etc.

Similar to the front opening 3 of the outer envelope, the front opening 11*c* of the inner envelope 11 can be closed by any closure means 11*g* known in itself, such as a zipper, a self-gripping system, snap fasteners, buttons, etc.

These closure mechanism 11*g* are separate from those of the outer envelope, so that the inner envelope 11 can be closed nearest the user's upper body.

According to another aspect of the invention, the inner envelope 11 includes a series of pockets 14, 15, 16 adapted to receive various objects such as a wallet, portable telephone, a portable cassette, CD or other audio player, glasses, etc. In the example shown, the pocket 14 is an internal pocket provided with a closure of the zipper type, the pocket 15 is an external pocket provided more particularly for a telephone, and the pocket 16 is also an external pocket with a wide opening for larger objects.

As a result, these various objects, which can be more or less heavy, are carried directly in contact with the body or, in any event nearest the body, and are thereby much less tossed around and shaken during the sporting activity than if they were carried by the outer envelope 1.

Therefore, the user experiences an increased comfort, and the risk of losing these various objects is reduced.

Preferably, the inner envelope 11 and especially the two front panels 11*d*, 11*e* thereof are made of an at least partially extensible material.

To this end, these panels are made, for example, of a slightly extensible net or mesh-type material. This construction makes it possible to adapt to the various users' morphologies, and to take into account the size of the objects placed in the pockets. The rear portion 11*f* is preferably made of an inextensible material.

Preferably, and depending on the intended use, the inner envelope 11 is also at least partially made of one of the so-called "breathing" materials, i.e., ventilated materials enabling perspiration to be evacuated.

This is especially the case of the front panels 11*d*, 11*e*.

As can be seen in the various figures of the drawing, the inner envelope 11, as well as an aggregate of panels of which the inner envelope is comprised, such as panels 11*d*, 11*e*, and 11*f*, extend continuously around the girth of the upper portion of the user's body.

For example, in this regard, the right front panel 11*d* is affixed to the rear panel 11*f* and the rear panel 11*f* is affixed to the left front panel 11*e*, so that panels 11*d*, 11*e*, and 11*f* have an aggregate horizontal dimension that envelops the girth of the upper portion of the user's body, when the generally vertically extending front opening 11*c* of the inner envelope is closed, thereby bringing together the left and right sides of the inner envelope, i.e., the right front panel 11*d* and the left front panel 11*e*, by means of closure 11*g*, such as a zipper, as shown.

In the preferred embodiment illustrated in the exemplary drawing, the upper end of the inner envelope 11 terminates beneath the upper surface of the shoulders of the user and, therefore, the inner envelope 3 has a vertical dimension considerably less than the vertical dimension of the outer envelope 1. In fact, in the illustrated embodiment, although the inner envelope 3 extends upwardly to an area close to and beneath the arms of the user, the inner envelope 3 includes no openings for encircling the arms of the user.

According to a preferred embodiment, a "horizontal" panel 13 made of a ventilated material is also provided at the upper end 11*a* of the inner envelope, directly beneath the seam 12 (or the like) of the attachment to the outer envelope. Preferably, this horizontal panel 13 extends to the upper end of each of the panels 11*d*, 11*e*, 11*f*.

In the case in which the jacket is adapted to be used for a winter sport, the inner envelope 11 is advantageously provided at its lower end 11*b* with a skirt 17 made of a waterproof material enveloping the entire bottom of the user's upper body, and extending downward to the hips.

This skirt 17 is further provided with an elastic portion 17*a* or the like to perfectly adjust to the contour of the user's hips.

As a result, the skirt 17 protects the user's waist against the inadvertent penetration of outside elements, such as snow.

According to one advantageous embodiment, an arrangement 18 for connecting to the belt or a waistband of the pants or shorts can be provided on the inner surface of the inner envelope 11.

This connecting arrangement can be constituted by buttons, snap fasteners, etc. In the example shown, it is constituted by straps provided with a hook and loop fastening system 18*a* and capable of encircling a belt/waistband in the form of loops.

Finally, the inner envelope 11 can be provided, along its front opening 11*c* and on each of the front panels 11*d*, 11*e*, with a connection system 19 complementary to connection system 9 provided on the inner surface 1*b* of the outer envelope 1 along the opening 3 of the latter.

These connection systems 9, 19 serve to affix the inner envelope 11 to the outer envelope 1 when one wishes to maintain this inner envelope open. They can take the form of a hook and loop fastening system, buttons, snap fasteners, etc. Preferably, the connection system 19 is fixed on fixing lugs 19*a* as shown in the drawing. The same can also be true for the opposite, i.e., the connection system 9 of the outer envelope includes such connection lugs.

The present invention is not limited to the particular embodiments described hereinabove, but can be applied to any type of garment for which similar or equivalent problems must be resolved.

What is claimed is:

1. A garment of the jacket type comprising:

an outer envelope to cover an upper portion of a user's body, said outer envelope including a closure system;

an inner envelope distinct from said outer envelope, said inner envelope comprising an inner carrying system to envelop at least a portion of a height of the upper body of the user, wherein an upper portion of said inner envelope is connected to said outer envelope, wherein said inner envelope further comprises a closure system separate from any closure system of said outer envelope, and wherein said inner envelope further comprises a pocket arrangement for carrying objects.

2. A garment according to claim 1, wherein said inner envelope is fixed to said outer envelope in an area of the torso of the user.

3. A garment according to claim 2, wherein said inner envelope is fixed to said outer envelope in an area of the chest of the user.

4. A garment according to claim 1, wherein said inner envelope is detachably fixed to said outer envelope.

5. A garment according to claim 1, wherein said inner envelope is provided in an upper end area with a ventilation band.

6. A garment according to claim 1, wherein said inner envelope is at least partially extensible at least in a front zone.

7. A garment according to claim 1, wherein said inner envelope is provided in an area of said closure system with means for connection to said outer envelope.

8. A garment according to claim 1, wherein said inner envelope is provided with a means for connection to a belt or waistband of pants.

9. A garment according to claim 1, wherein said inner envelope is made, at least partially, of a ventilated material of the net type.

10. A garment according to claim 1, wherein said inner envelope has a substantially cylindrical shape and envelops the user's upper body at the waist and chest, but said inner envelope not extending to an area corresponding to an upper surface of the user's shoulders.

11. A garment according to claim 10, wherein said inner envelope extends downwardly to an area corresponding to the user's hips.

12. A garment according to claim 1, wherein an upper end of said inner envelope is detachably fixed to said outer envelope in an area of the torso of the user.

13. A garment according to claim 12, wherein said inner envelope is detachably fixed to said outer envelope by means of a zipper extending around the area of the torso of the user.

14. A garment according to claim 1, wherein an upper end of said inner envelope is detachably fixed to said outer envelope in an area of the chest of the user.

15. A garment according to claim 14, wherein said inner envelope is detachably fixed to said outer envelope by means of a zipper extending around the area of the chest of the user.

16. A garment of the jacket type comprising:

an outer envelope to cover an upper portion of a user's body, said outer envelope including a closure system;

an inner envelope distinct from said outer envelope, said inner envelope comprising an inner carrying system to envelop at least a portion of a height of the upper body of the user;

an upper portion of said inner envelope being connected to said outer envelope;

said inner envelope further comprising a closure system separate from any closure system of said outer envelope;

said inner envelope further comprising a pocket arrangement for carrying objects; and said inner envelope being provided at a lower end with a skirt made of a waterproof material extending up to an area of the hips of the user and provided with an elastic material at said lower end.

17. A garment according to claim 16, wherein said inner envelope is fixed to said outer envelope in an area of the torso of the user.

18. A garment according to claim 17, wherein said inner envelope is fixed to said outer envelope in an area of the chest of the user.

19. A garment according to claim 16, wherein said inner envelope is detachably fixed to said outer envelope.

20. A garment according to claim 16, wherein said inner envelope is provided in an upper end area with a ventilation band.

21. A garment according to claim 16, wherein said inner envelope is at least partially extensible at least in a front zone.

22. A garment according to claim 16, wherein said inner envelope is provided in an area of said closure system with means for connection to said outer envelope.

23. A garment according to claim 16, wherein said inner envelope is provided with a means for connection to a belt or waistband of pants.

24. A garment according to claim 16, wherein said inner envelope is made, at least partially, of a ventilated material of the net type.

25. A garment according to claim 16, wherein said inner envelope has a substantially cylindrical shape and envelops the user's upper body at the waist and chest, but said inner envelope not extending to an area corresponding to an upper surface of the user's shoulders.

26. A garment according to claim 25, wherein said inner envelope extends downwardly to an area corresponding to the user's hips.

27. A garment according to claim 16, wherein an upper end of said inner envelope is detachably fixed to said outer envelope in an area of the torso of the user.

28. A garment according to claim 27, wherein said inner envelope is detachably fixed to said outer envelope by means of a zipper extending around the area of the torso of the user.

29. A garment according to claim 16, wherein an upper end of said inner envelope is detachably fixed to said outer envelope in an area of the chest of the user.

30. A garment according to claim 29, wherein said inner envelope is detachably fixed to said outer envelope by means of a zipper extending around the area of the chest of the user.

31. A garment of the jacket type comprising:

an outer envelope to cover an upper portion of a user's body, said outer envelope including a closure system to close and open said outer envelope relative to the upper portion of the user's body;

a carrying system comprising:

an inner envelope, said inner envelope being separate from said outer envelope and positioned within said outer envelope when said outer envelope is closed upon the upper portion of the user's body, said inner envelope including a closure system separate from said closer system of said outer envelope, said closure system of said inner envelope enabling said inner envelope to be opened or closed relative to the upper portion of the user's body;

said inner envelope enveloping a girth of the upper portion of the user's body and having an upper portion connected to said outer envelope;

a pocket arrangement for carrying objects, said pocket arrangement being affixed to said inner envelope, whereby carried objects can be carried in close contact with the user's body independently of said outer envelope.

32. A garment of the jacket type comprising:

an outer envelope to cover an upper portion of a user's body, said outer envelope including a closure system;

an inner envelope distinct from said outer envelope, said inner envelope comprising an inner carrying system to extend continuously around at least a portion of a height of the upper body of the user, wherein an upper portion of said inner envelope is connected to said outer envelope, wherein said inner envelope further comprises a closure system separate from any closure system of said outer envelope, and wherein said inner envelope further comprises a pocket arrangement for carrying objects.

33. A garment of the jacket type comprising:

an outer envelope to envelop an upper portion of a user's body, said outer envelope including a closure system;

an inner carrying system positioned internally of said outer envelope, said inner carrying system including an inner envelope and an arrangement of pockets positioned on said inner envelope for carrying objects, said inner envelope adapted to envelop the user's body but to extend vertically less than a vertical extent of said outer envelope, wherein an upper portion of said inner envelope is connected to said outer envelope, wherein said inner envelope further comprises a closure system separate from any closure system of said outer envelope.

34. A garment according to claim 33, wherein said inner envelope is distinct from said outer envelope.

35. A garment of the jacket type comprising:

an outer envelope having a horizontal dimension to envelop a girth of an upper portion of a user's body and a vertical dimension to extend along a predetermined height of the upper portion of a user's body and to extend over the user's shoulders and provide openings for the user's arms, said outer envelope having a surface constituting an outermost surface of said jacket;

an outer envelope closure system to open and close said outer envelope selectively relative to the upper portion of the user's body;

an inner envelope distinct from said outer envelope, said inner envelope comprising a plurality of panels, each of said plurality of panels being affixed to another of said plurality of panels, said plurality of panels having an aggregate horizontal dimension to envelop the girth of the upper portion of the user's body and a vertical dimension less than said vertical dimension of said outer envelope, said plurality of panels having an uppermost extent beneath an area corresponding to the user's shoulders;

an inner envelope closure system, distinct from said outer envelope closure system, to open and close said inner envelope selectively relative to the upper portion of the user's body;

said inner envelope further comprising a plurality of pockets positioned on one or more of said plurality of panels whereby said inner envelope, with said plurality of pockets, constitutes an inner carrying system of the garment.

36. A garment according to claim 35, wherein:

said inner envelope extends continuously around at least a portion of a height of the upper body of the user.

37. A garment according to claim 35, wherein:

said inner envelope includes no openings for arms of the user.

38. A garment according to claim 35, wherein:

said inner envelope closure system extends generally vertically in a frontal area to open and close right and left sides of said inner envelope;

said inner envelope comprises an upper end, at least a portion of said upper end of said inner envelope extending from said right side, through a rear area of said inner envelope, and to said left side;

said inner envelope is fixed to said outer envelope along said upper end of said inner envelope.

39. A garment according to claim 38, wherein:

said inner envelope is fixed to said outer envelope by means of a detachable fixing mechanism along said upper end of said inner envelope.

40. A garment according to claim 39, wherein:

said detachable fixing mechanism comprises a zipper.

* * * * *